US010271124B2

(12) United States Patent
Lin et al.

(10) Patent No.: US 10,271,124 B2
(45) Date of Patent: Apr. 23, 2019

(54) EARPHONE

(71) Applicant: Merry Electronics (Shenzhen) Co., Ltd., Guangdong (CN)

(72) Inventors: Chia-Chung Lin, Taichung (TW); Yun-Chun Wu, Taichung (TW)

(73) Assignee: Merry Electronics (Shenzhen) Co., Ltd., Guangdong (CN)

( * ) Notice: Subject to any disclaimer, the term of this patent is extended or adjusted under 35 U.S.C. 154(b) by 0 days.

(21) Appl. No.: 15/701,440

(22) Filed: Sep. 11, 2017

(65) Prior Publication Data

US 2018/0167712 A1 Jun. 14, 2018

(30) Foreign Application Priority Data

Dec. 9, 2016 (TW) ..... 105140840 A
May 26, 2017 (TW) ..... 106117492 A

(51) Int. Cl.
*H04R 1/10* (2006.01)
*H04R 1/28* (2006.01)

(52) U.S. Cl.
CPC ..... *H04R 1/1016* (2013.01); *H04R 1/105* (2013.01); *H04R 1/1066* (2013.01); *H04R 1/2849* (2013.01); *H04R 1/1083* (2013.01); *H04R 1/1091* (2013.01); *H04R 2460/01* (2013.01); *H04R 2460/11* (2013.01)

(58) Field of Classification Search
CPC .... H04R 1/1016; H04R 1/105; H04R 1/1066; H04R 1/2849; H04R 1/1083; H04R 1/1091; H04R 2460/01; H04R 2460/11
See application file for complete search history.

(56) References Cited

U.S. PATENT DOCUMENTS 6,412,593 B1 * 7/2002 Jones ..... H04R 1/1008 181/129
2011/0058704 A1 * 3/2011 Harlow ..... H04R 1/1016 381/380
2016/0309250 A1 * 10/2016 Kelly ..... H04R 1/1066
2017/0094384 A1 * 3/2017 Trainer ..... H04R 1/105
2017/0094386 A1 * 3/2017 Trainer ..... H04R 1/1016

FOREIGN PATENT DOCUMENTS

CN 2487187 4/2002
CN 205195912 4/2016
TW M453318 5/2013
WO WO-2010005039 A1 * 1/2010 ..... H04R 1/1016

* cited by examiner

*Primary Examiner* — Sunita Joshi
(74) *Attorney, Agent, or Firm* — JCIPRNET

(57) ABSTRACT

An earphone including a housing, a first speaker and an audio outlet is provided. The housing includes an insertion end and a main body. The insertion end is into the entrance of a user's ear when worn by the user, and the main body extends from the insertion end and defines an auricle contact surface and an external connecting surface opposite to the auricle contact surface. The auricle contact surface faces the user's auricle and the external connecting surface communicates to the external environment when the earphone is worn. The first speaker is contained within the main body to divide into a front chamber and a first rear chamber. A part of the first rear chamber is adjacent to the auricle contact surface. A sound output surface of the first speaker faces the external connecting surface. The audio outlet is formed in the insertion end to let out the sound.

16 Claims, 6 Drawing Sheets

EARPHONE

CROSS-REFERENCE TO RELATED APPLICATION

This application claims the priority benefit of Taiwan application serial no. 105140840, filed on Dec. 9, 2016 and Taiwan application serial no. 106117492, filed on May 26, 2017. The entirety of the above-mentioned patent application is hereby incorporated by reference herein and made a part of this specification.

BACKGROUND OF THE INVENTION

1. Field of the Invention

The invention is related to an earphone.

2. Description of Related Art

With advancement of technologies, the current trends in electronic products are compact and light designs. Compact-sized electronic products such as radios, Walkman or smart phones are used at any time everywhere. No matter what electronic product is used, in order for users to listen to audio information sent from the electronic product without disturbing other people, earphones are made as essential accessories for electronic products.

In general, for earphones with smaller volume, such as in-ear or half in-ear earphones, in order for users to obtain better sound quality, sound output surfaces of speakers of the earphones are usually set to face towards the sound outlets; as a result, available spaces inside the earphone with smaller volume are limited, thereby making it difficult for the earphones to have a variety of functions. Therefore, it is an issue to be solved by persons skilled in the art to improve the structures of the earphones to enable the earphones to have different functions while maintaining their sound quality.

SUMMARY OF THE INVENTION

The invention is directed to an earphone, which is capable of flexibly utilizing an internal space of the earphone so as to enable the earphone to maintain its sound quality in addition to having a variety of functions.

The earphone of the invention includes a housing, a first speaker and an audio outlet. The housing includes an insertion end and a main body. The insertion end is into the entrance of a user's ear when worn by the user. The main body extends from the insertion end and defines an auricle contact surface and an external connecting surface opposite to the auricle contact surface. The auricle contact surface of the main body faces the auricle of the user, and the external connecting surface communicates to an external environment when the earphone is worn. The first speaker is contained within the main body of the housing to divide the main body into a front chamber and a first rear chamber. A part of the first rear chamber of the main body is adjacent to the auricle contact surface of the main body. A sound output surface of the first speaker faces the external connecting surface of the housing. The audio outlet is formed in the insertion end of the housing so as to let out the sound.

In an embodiment of the invention, the earphone further includes a first tuning hole. The first tuning hole is formed in the main body of the housing so as to communicate the first rear chamber with the external environment.

In an embodiment of the invention, the earphone further includes a partition. The partition is disposed inside the main body of the housing and between the external connecting surface and the first speaker. The partition and the external connecting surface define an accommodation space therebetween.

In an embodiment of the invention, the earphone further includes at least a functional element. The functional element is located inside the accommodation space.

In an embodiment of the invention, the earphone further includes a front chamber tuning hole. The front chamber tuning hole is formed in the external connecting surface of the main body of the housing so as to communicate the front chamber with outside of the housing.

In an embodiment of the invention, the earphone further includes a partition and a second speaker. The partition is disposed inside the main body of the housing and located between the external connecting surface and the first speaker. The second speaker is contained within the housing and connected between the partition and the main body. The partition and the second speaker and the first speaker share the front chamber with the first speaker, and a second rear chamber is defined by the second speaker and the external connecting surface.

In an embodiment of the invention, the earphone further includes a second tuning hole. The second tuning hole is formed in the external connecting surface of the main body of the housing so as to communicate the second rear chamber with outside of the housing.

In an embodiment of the invention, the earphone further includes a baffle. The baffle is located between the auricle contact surface of the main body and the first speaker and communicates to the front chamber.

In view of the above, in the earphone of the invention, the first speaker is contained within the main body of the housing so as to divide the main body into the front chamber and the first rear chamber. Further, a part of the first rear chamber of the main body is adjacent to the auricle contact surface of the main body. Under such configuration, the earphone of the invention has the accommodation space for installing other functional elements and also has more spatially varying applications, and thus the earphone may have a variety of functions.

In order to make the aforementioned features and advantages of the invention more comprehensible, embodiments accompanying figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
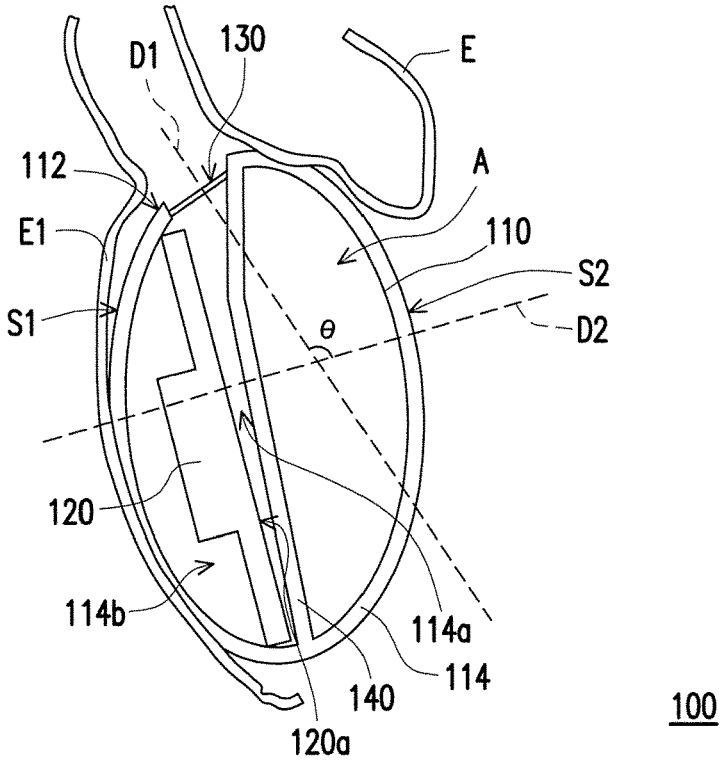
FIG. 1 is a schematic view illustrating an earphone according to a first embodiment of the invention.

FIG. 1 is a schematic view illustrating an earphone 100 according to a first embodiment of the invention. Referring to FIG. 1, the earphone 100 of the present embodiment includes a housing 110, a first speaker 120 and an audio outlet 130. The housing 110 includes an insertion end 112 and a main body 114. The insertion end 112 may be inserted into the entrance of a user's ear E when worn by the user. The main body 114 extends from the insertion end 112 and defines an auricle contact surface S1 and an external connecting surface S2 opposite to the auricle contact surface S1. The auricle contact surface S1 of the main body 114 faces towards an auricle E1 of the user, and the external connecting surface S2 communicates to an external environment when the earphone 100 is worn. The first speaker 120 is contained within the main body 114 of the housing 110 to divide the main body 114 into a front chamber 114*a* and a first rear chamber 114*b*. A part of the first rear chamber 114*b* of the main body 114 is adjacent to the auricle contact surface S1 of the main body 114. That is, at least a part of the first rear chamber 114*b* of the main body 114 is adjacent to the auricle contact surface S1 of the main body 114. Further, a sound output surface 120*a* of the first speaker 120 faces towards the external connecting surface S2 of the housing 110. The audio outlet 130 is formed in the insertion end 112 of the housing 110 so as to let out the sound from the first speaker 120.

In addition, in the present embodiment, an included angle θ between an extending direction D1 of the audio outlet 130 and a normal direction D2 of the first speaker 120 is greater than or equal to 90 degrees. It can be noted that, in other embodiments, the included angle θ between the extending direction D1 of the audio outlet 130 and the normal direction D2 of the first speaker 120 may also be set as less than 90 degrees depending on the actual design requirements. Moreover, in the present embodiment, the earphone 100 further includes a partition 140. The partition 140 is disposed inside the main body 114 of the housing 110 and between the external connecting surface S2 and the first speaker 120. The partition 140 and the external connecting surface S2 define an accommodation space A therebetween. In other words, the front chamber 114*a* is a space between the first speaker 120 and the accommodation space A, and the disposition of the partition 140 may be adjusted depending on the actual design requirements so as to change a size of volume of the front chamber 114*a*. In general, the smaller the volume of the front chamber 114*a*, the more conducive for enhancing the high-frequency response, as well as for enhancing the effect of sound quality. In one embodiment, the main body 114 of the housing 110 may be flexible. For example, a material of the main body 114 may include urethane foam material, silicone, rubber or other elastic polymer material. When an external force is applied onto the main body 114, the auricle contact surface S1 and/or the external connecting surface S2 may be deformed. Other details regarding the housing containing the elastic material will be described in the later embodiment.

Figure 2:
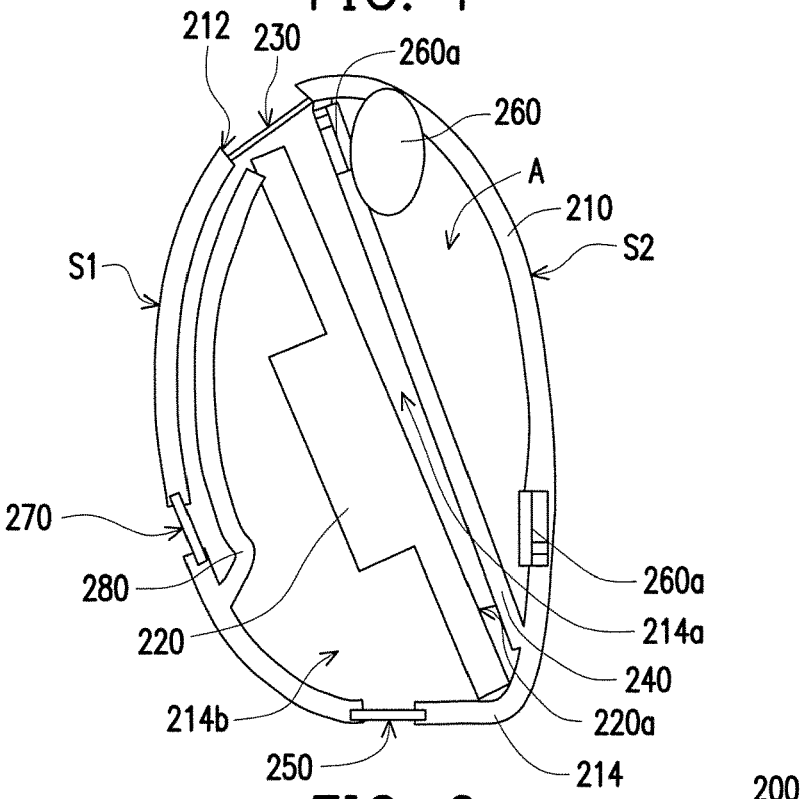
FIG. 2 is a schematic view illustrating an earphone according to a second embodiment of the invention.

FIG. 2 is a schematic view illustrating an earphone 200 according to a second embodiment of the invention. Referring to FIG. 1 and FIG. 2, identical or similar numbers refer to identical or similar elements throughout the drawings, and no repetition will be incorporated in the descriptions. The earphone 200 of the present embodiment is similar to the earphone 100 of FIG. 1, except that a main difference therebetween, for example, lies in that the earphone 200 further includes a first tuning hole 250 and at least one functional element 260. In addition, the first tuning hole 250 is formed in the main body 214 of the housing 210 so as to communicate the first rear chamber 214*b* with outside of the housing 210. The functional element 260 is located inside the accommodation space A. For instance, the functional element 260 includes an active noise cancellation (ANC) element 260*a*, a heart rate monitor (HRM) (refer to 460*b* in FIG. 4D) or other sensing elements.

In the present embodiment, the earphone 200 further includes a front chamber tuning hole 270. The front chamber tuning hole 270 is, for example, formed in the auricle contact surface S1 of the main body 214 so as to communicate the front chamber 214*a* with outside of the housing 210. With the disposition of the front chamber tuning hole 270, a sense of occlusion may be prevented when the user wears the earphone for a long-time. In addition, the earphone 200 further includes a baffle 280. The baffle 280 is located between the auricle contact surface S1 of the main body 214 and the first speaker 220 and communicates to the front chamber 214*a*. Two ends of the baffle 280 are respectively connected to the first speaker 220 and the housing 210, and an inclination angle of the first speaker 220 may be adjusted by the baffle 280. It is to be explained that, the design of the baffle 280 as shown in FIG. 2 is merely provided as an example and should not be construed as a limitation to the invention.

Figure 3A:
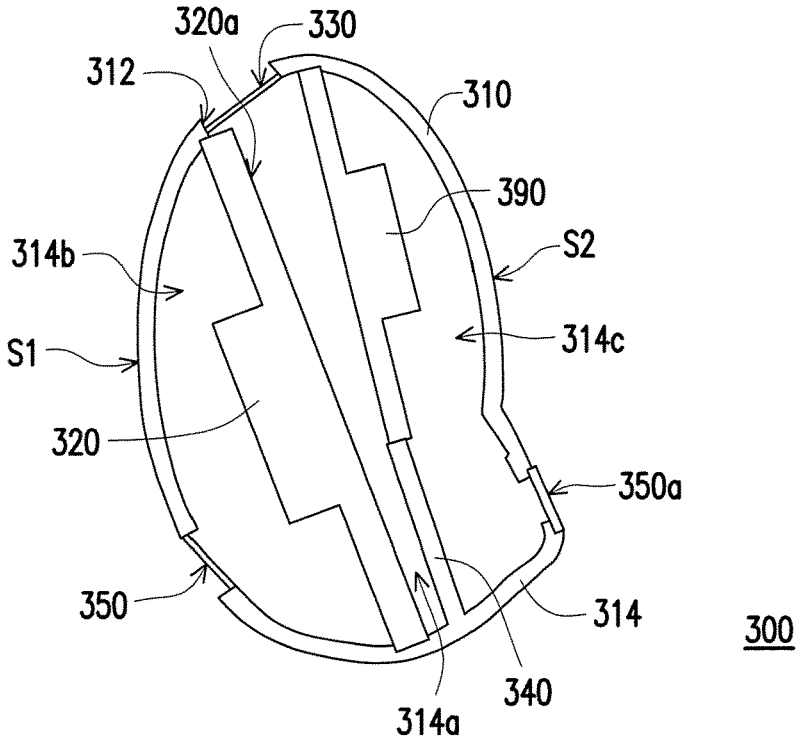
FIG. 3A and FIG. 3B are schematic views respectively illustrating an earphone according to a third embodiment of the invention.
Figure 3B:
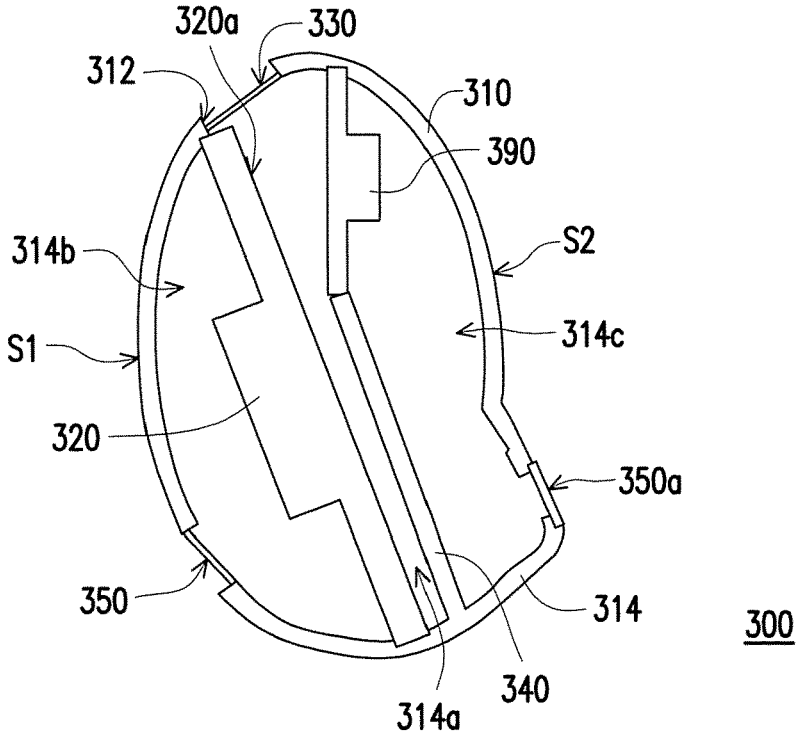

FIG. 3A and FIG. 3B are schematic views respectively illustrating an earphone 300 according to a third embodiment of the invention. Referring to FIG. 1, FIG. 3A and FIG. 3B, identical or similar numbers refer to identical or similar elements throughout the drawings, and no repetition will be incorporated in the descriptions. The earphone 300 of the present embodiment is similar to the earphone 100 of FIG. 1, except that a main difference between the two, for example, lies in that the earphone 300 further includes a second speaker 390. The second speaker 390 is contained within the housing 310 and connected between the partition 340 and the main body 314. A sound output surface of the second speaker 390 may be disposed as facing towards the audio outlet 330. That is to say, the sound output surface 320*a* of the first speaker 320 and the sound output surface of the second speaker 390 are facing towards each other. In addition, a size of the second speaker 390 is, for example, smaller than a size of the first speaker 320. As such, the first speaker 320 and the second speaker 390 may be used to emit sound waves of different frequency bands; for instance, the first speaker 320 is responsible for a low or medium-low pitch sound range, while the second speaker 390 is responsible for a high pitch sound range. Since the earphone 300 has both the first speaker 320 and the second speaker 390, the overall frequency response range of the earphone 300 may be expanded, thereby providing a favorable sound quality performance.

In the present embodiment, the partition 340 is between the external connecting surface S2 and the first speaker 320. The partition 340 and the second speaker 390 share the front chamber 314*a* with the first speaker 320, and a second rear chamber 314*c* is defined by the second speaker 390, the partition 340 and the external connecting surface S2. In the present embodiment, the earphone 300 further includes a first tuning hole 350 and a second tuning hole 350*a*. The first tuning hole 350 is formed in the auricle contact surface S1 of the main body 314 of the housing 310 so as to communicate the first rear chamber 314*b* with outside of the housing 310. The second tuning hole 350*a* is formed in the external connecting surface S2 of the main body 314 of the housing 310 so as to communicate the second rear chamber 314*c* with outside of the housing 310.

A main difference between FIG. 3A and FIG. 3B lies in the size and the disposition of the second speaker 390. In addition, in the embodiment of FIG. 3B, the second speaker 390 is, for example, a speaker of smaller size, which enables the sound output surface of the second speaker 390 is more close to the audio outlet 330, so that the second speaker 390 is more close to the user's eardrum, and thus is capable of providing a high-quality sound output of high pitch sound range. Relative positions and sizes of the first speaker 320 and the second speaker 390 may all be adjusted depending on the actual design requirements so as to meet the different demands of the user in terms of sound quality or timbre, and should not be construed as a limitation to the invention. In one embodiment, the earphone 300 may also include a front chamber tuning hole (not shown). The front chamber tuning hole is, for example, provided on the main body 314 between the first speaker 320 and the second speaker 390 so as to communicate the front chamber 314*a* with outside of the housing 310.

FIG. 4A, FIG. 4B, FIG. 4C and FIG. 4D are schematic views respectively illustrating an earphone 400-1, 400-2, 400-3, 400-4 according to a fourth embodiment of the invention. Referring to FIG. 1, FIG. 2 and FIG. 4A to FIG. 4D, identical or similar numbers refer to identical or similar elements throughout the drawings, and no repetition will be incorporated in the descriptions. The earphone 400-1 of the present embodiment is similar to the earphone 200 of FIG. 2, except that a main difference between the two, for example, lies in that the first speaker 420 of the earphone 400-1 may change its size and its included angle θ depending on the earphone appearance or different requirements of high or low frequency. In addition, depending on the number, the type or the size of the functional elements, the size of the accommodation space A may also adjusted in coordination with the partition 440, so that the earphone 400-1 has a variety of different space applications and changes.

Figure 4A:
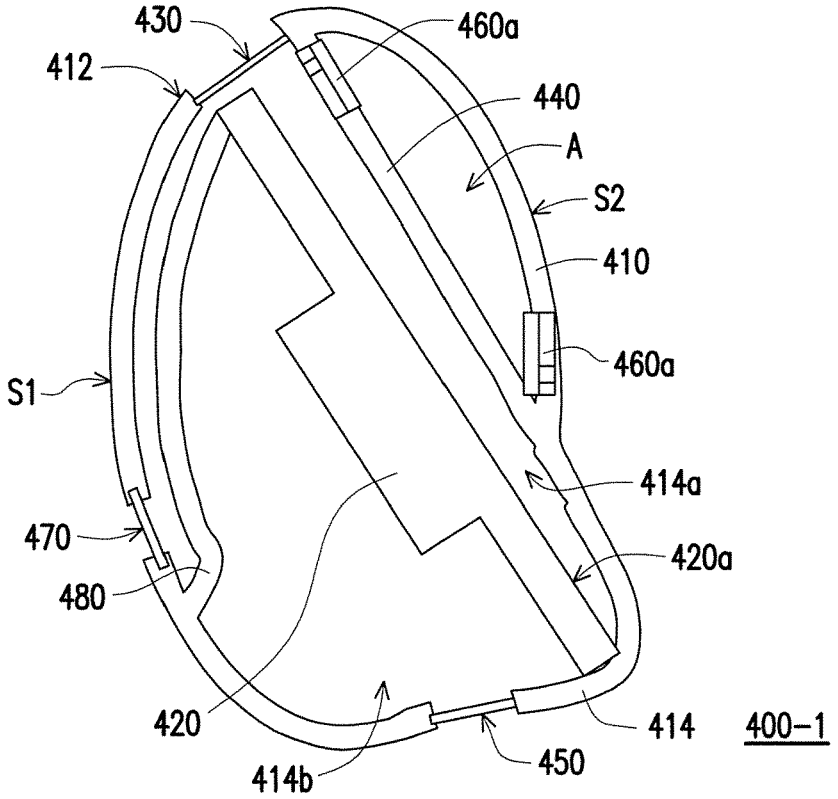
FIG. 4A to FIG. 4D are schematic views respectively illustrating an earphone according to a fourth embodiment of the invention.
Figure 4B:
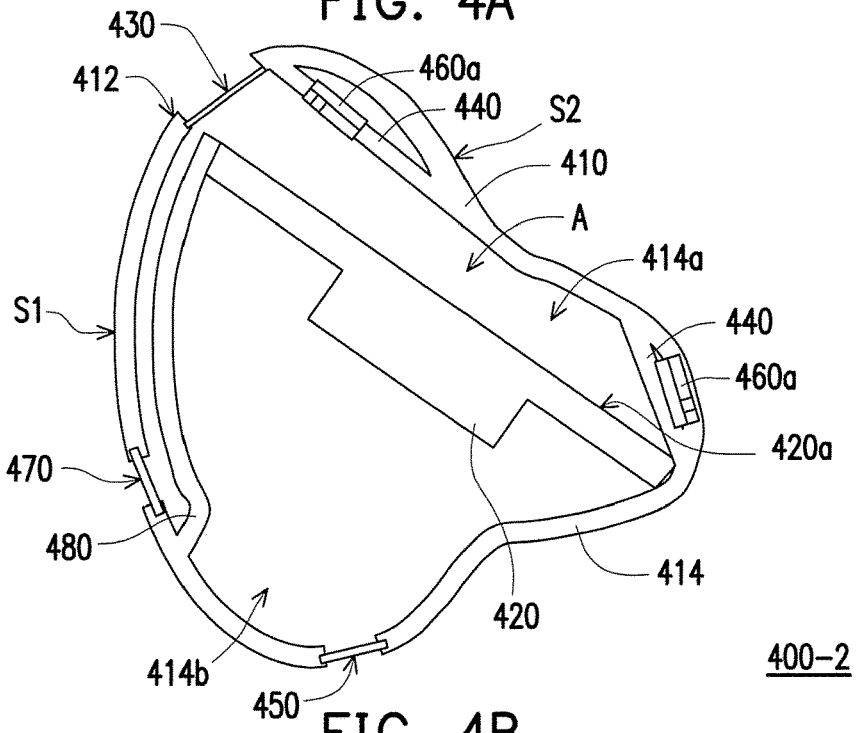

Next, a difference between the earphone 400-2 of FIG. 4B and the earphone 400-1 of FIG. 4A, for example, lies in that the earphone 400-2 of FIG. 4B may be configured with a larger first speaker 420, and an inclination angle of the first speaker 420 relative to the auricle contact surface S1 is greater. Therefore, when the user wears the earphone 400-2, a part of the earphone 400-2, for example, exceeds beyond the user's cavum conchae (not shown). The first speaker 420 with a larger volume may provide a better low frequency response, and thereby enables the user to obtain a different auditory experience. Moreover, the earphone 400-2 may further be configured with two partitions 440 inside the main body 414 of the housing 410, and the invention does not intend to limit the number of the partition. In the present embodiment, the two active noise cancellation elements 460*a* may be respectively disposed on the two partitions 440 and be both located in the accommodation space A. For instance, one of the active noise cancellation components 460*a* may be disposed near the audio outlet 430 to receive noises inside the ear canal, while the other one of the active noise cancellation elements 460*a* may have its sound receiving hole faced towards the outside to receive noises from the external environment. Under such configuration, noises can be collected more comprehensively, thereby achieving a better noise reduction effect.

Figure 4C:
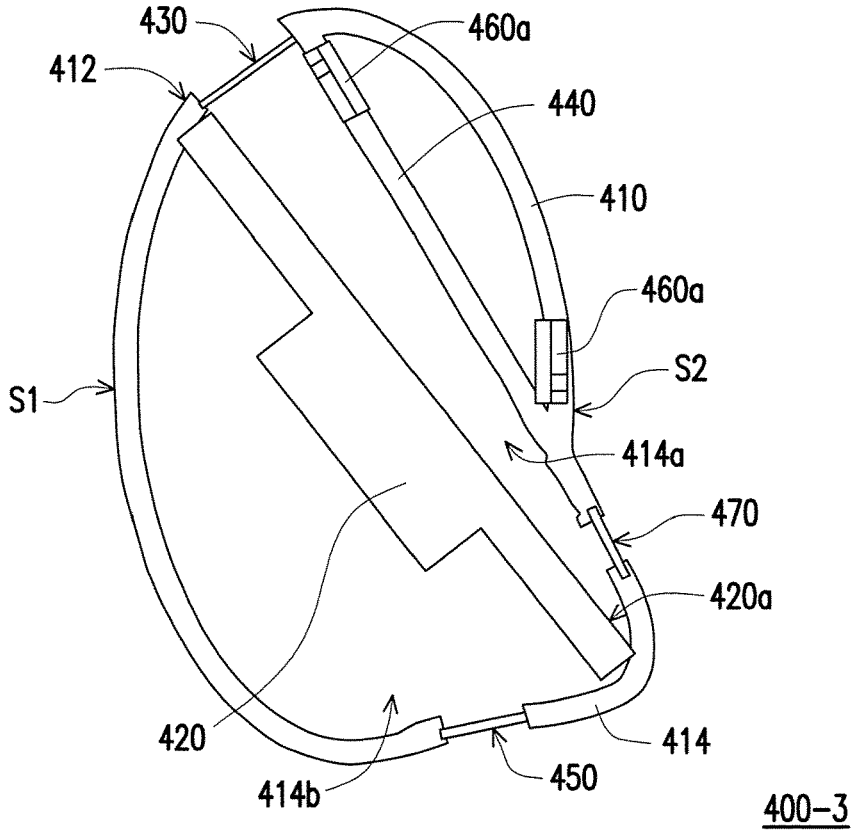

Further, a difference between the earphone 400-3 of FIG. 4C and the earphone 100 of FIG. 1, for example, lies in that the earphone 400-3 of FIG. 4C includes a front chamber tuning hole 470 and a first tuning hole 450. The front chamber tuning hole 470 is formed in the external connecting surface S2 of the main body 414 of the housing 410 so as to communicate the front chamber 414*a* with outside of the housing 410. The first tuning hole 450 is formed in the main body 414 of the housing 410 so as to communicate the first rear chamber 414*b* with outside of the housing 410. In other words, as compared to the earphone 400-1 of FIG. 4A, the front chamber tuning hole 470 of the earphone 400-3 of FIG. 4C is disposed on the external connecting surface S2. With the differences in disposition of the front chamber tuning hole 470, the earphone may be balanced with respect to high frequency and low frequency, and thereby enables the user to have a better sound quality.

Figure 4D:
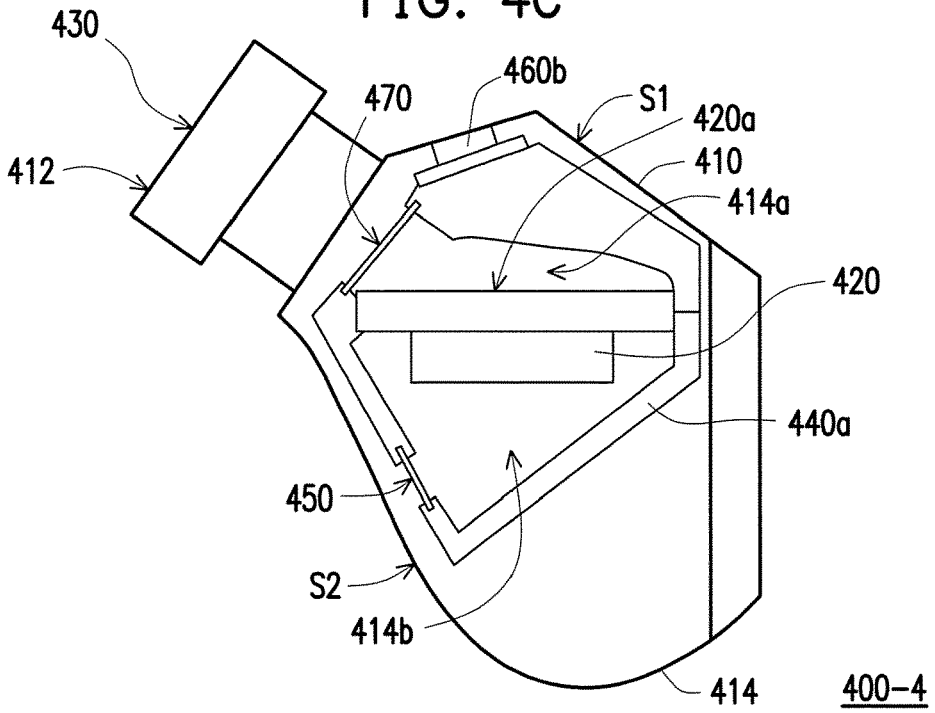

Moreover, a difference between the earphone 400-4 of FIG. 4D and the earphone 200 of FIG. 2, for example, lies in that the earphone 400-4 of FIG. 4D includes a heart rate monitoring sensor 460*b*. Since heart rate is a very important physiological indicator for human body exercise, a result of heart rate sensing not only can be used to evaluate the user's physical condition but also can be used to determine the user's cardiopulmonary function, thereby serving as an exercise intensity indicator, energy consumption or sport training effect evaluation and so forth. Therefore, by disposing the heart rate monitoring sensor 460*b* inside the accommodation space in the earphone 400-4, the space inside the earphone 400-4 may be effectively used. The structure of the earphone 400-4 is simple and high in practicality. In addition, an included angle between a plane on which the heart rate monitoring sensor 460*b* locates and the sound output surface 420*a* of the first speaker 420 may also be adjusted depending on the earphone appearance and the actual configurational condition, and should not be construed as a limitation to the invention.

Figure 5A:
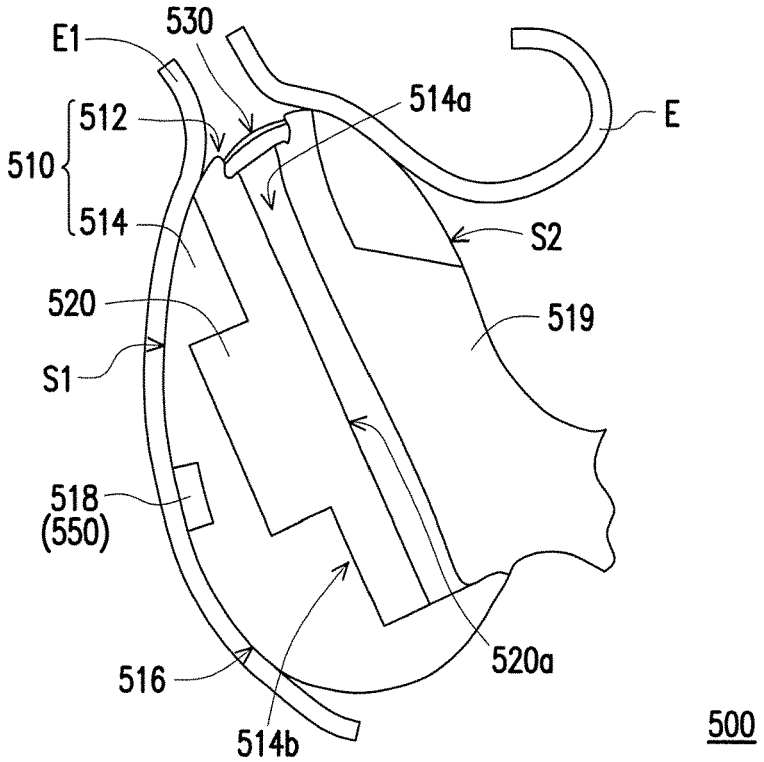
FIG. 5A is a schematic view illustrating an earphone according to a fifth embodiment of the invention.

FIG. 5A is a schematic view illustrating an earphone according to a fifth embodiment of the invention. Referring to FIG. 5A, an earphone 500 of the present embodiment includes a deformable housing 510, a speaker 520 and an audio outlet 530. Specifically, the deformable housing 510 at least includes an insertion end 512 and a main body 514. The insertion end 512 is inserted into the ear E of the user. The main body 514 extends from the insertion end 512 and defines an auricle contact surface S1 and an external connecting surface S2 opposite to the auricle contact surface S1. When the user uses the earphone 500, the auricle contact surface S1 of the main body 514 faces towards the auricle E1 of the user, and the external connecting surface S2 communicates with the external environment when the earphone 500 is worn. Further, the speaker 520 is contained within the main body 514 of the deformable housing 510 to divide the main body 514 into a front chamber 514*a* and a rear chamber 514*b*. A part of the rear chamber 514*b* of the main body 514 is adjacent to the auricle contact surface S1 of the main body 514, and a sound output surface 520*a* of the speaker 520 faces towards the external connecting surface S2. Moreover, the audio outlet 530 of the earphone 500 may be formed in the insertion end 512 of the deformable housing 510 so that the sound from the speaker 520 can be guided into the ear E of the user through the audio outlet 530. The earphone 500 of the present embodiment is similar to the earphone 100 of FIG. 1, that is, configurations of the speaker 520 and the audio outlet 530 are similar to that of the first speaker 120 and the audio outlet 130 of the earphone 100. The main difference between the earphone 500 of the present embodiment and the earphone 100 in FIG. 1 lies in the design of the deformable housing 510.

For instance, the deformable housing 510 includes a deformation region 516. The deformation region 516 may face towards the rear chamber 514*b* of the main body 514. In one embedment, the deformation region 516 may constitute the main body 514 and wrap the speaker 520 therein. For instance, a material of the deformation region 516 includes elastic material, such as polyurethane foam, silicone, rubber or other elastic polymer material. In one embodiment, an elastic modulus of the material of the deformation region 516 is, for example, between 0.01 GPa and 4 GPa; and preferably, the elastic modulus is, for example, between 0.01 GPa and 0.2 GPa. In this way, when the user uses the earphone 500, the deformation region 516 can produce an elastic deformation in conformity with the shape of the auricle E1 of the user. That is, with the material characteristics of the deformable housing 510, when the user uses the earphone 500, the user is able to comfortably place the earphone 500 in the ear canal without requiring to be additionally inserted with an earplug, and the deformable housing 510 can produce an elastic deformation in conformity with the auricle shapes of different users so as to meet the needs of different users. With the deformable housing 510 being able to conform with the auricle shape of the user, in addition to enhancing the comfort of the user, in terms of the quality of the sound outputted from the earphone, sound leakage is also reduced, thereby contributing to the improvement of sound quality.

In one embodiment, the deformable housing 510 includes a tuning hole 550. For instance, the tuning hole 550 is formed in the auricle contact surface S1 of the main body 514 of the deformable housing 510 to communicate the rear chamber 514*b* with the outside of the deformable housing 510. In one embodiment, a ventilation sheet 518 may further be included. For instance, the ventilation sheet 518 can be disposed at the auricle contact surface S1 of the main body 514 of the deformable housing 510 and disposed corresponding to the tuning hole 550. The ventilation sheet 518 can be used to control the ventilation volume. In addition, since the ventilation sheet 518 is disposed corresponding to the tuning hole 550, foreign matters can be prevented from entering the deformable housing 510 through the tuning hole 550 and thereby affecting the performance of the earphone. In detail, different parts of the deformable housing 510 have different functions. For instance, the deformation region 516 can produce an elastic deformation in conformity with the shape of the auricle E1, and the ventilation sheet 518 in addition to regulating the ventilation volume of the earphone 500 to avoid a sense of occlusion may also protect the speaker 520 from being overly squeezed to result in damage when the deformation region 516 produces the elastic deformation. Accordingly, as compared to the deformation region 516 that includes the elastic material, a material of the ventilation sheet 518 may include a rigid material. That is, a rigidity of the material of the ventilation sheet 518 is greater than a rigidity of the material of the deformation region 516. For instance, the material of the ventilation sheet 518 may be plastic, resin, composite material or other suitable material.

In addition, an orthogonal projection area (not shown) of the ventilation sheet 518 on a plane in which the sound output surface 520*a* of the speaker 520 is located may be located in an orthogonal projection area (not shown) of the speaker 520 and may be smaller than an orthogonal projection area of the speaker 520 on the sound output surface 520*a* thereof. In one embodiment, the orthogonal projection area of the ventilation sheet 518 on the plane in which the sound output surface 520*a* of the speaker 520 is located may cover or partially overlap the orthogonal projection area of the speaker 520 on the sound output surface 520*a* thereof. In other embodiments, the orthogonal projection area of the ventilation sheet 518 on the plane in which the sound output surface 520*a* of the speaker 520 is located do not overlap with the orthogonal projection area of the speaker 520 on the sound output surface 520*a* thereof. The invention does not intend to limit the position of the ventilation sheet 518 on the auricle contact surface S1 of the main body 514, and also does not intend to limit the size of the ventilation sheet 518.

Moreover, the ventilation sheet 518 of the deformable housing 510 and the deformation region 516 of the deformable housing 510 are, for example, integrally formed. A method of integrally forming the two, for example, includes double injection molding, insertion molding or other suitable means, and the invention is not limited thereto. Accordingly, the ventilation sheet 518 is not required to be additionally assembled onto the deformable housing 510, and thereby simplifies the assembly process of the earphone 500. Furthermore, the ventilation sheet 518 and the deformation region 516 can be firmly combined, and thus the ventilation sheet 518 may not easily fall off due to long-time use and thereby affect the sound performance of the earphone 500. Moreover, by disposing the ventilation sheet 518 on the auricle contact surface S1 and corresponding to the rear chamber 514*b*, the auricle contact surface S1 of the main body 514 can be spaced apart from the speaker 520 when the deformation region 516 produces the elastic deformation, so that the volume of the rear chamber 514*b* will not be excessively squeezed and thereby affects the sound quality of the earphone 500.

Moreover, the deformable housing 510 further includes a supporting member 519. The supporting member 519 is, for example, contained within the main body 514 and connected to the speaker 520 so as to support the speaker 520 inside the deformable housing 510. The supporting member 519 may face towards the front chamber 514*a* of the main body 514. That is, when the deformation region 516 of the deformable housing 510 produces an elastic deformation as being subjected to an influence of an external force F, the supporting member 519 is configured to protect the front chamber 514*a* so as to maintain the shape of the front chamber 514*a*, thereby maintaining the quality of the sound. In addition, the earphone 500 uses the supporting member 519 to provide structural support, and thus can prevent the speaker 520 from being overly squeezed to cause the speaker 520 to shift or malfunction.

Figure 5B:
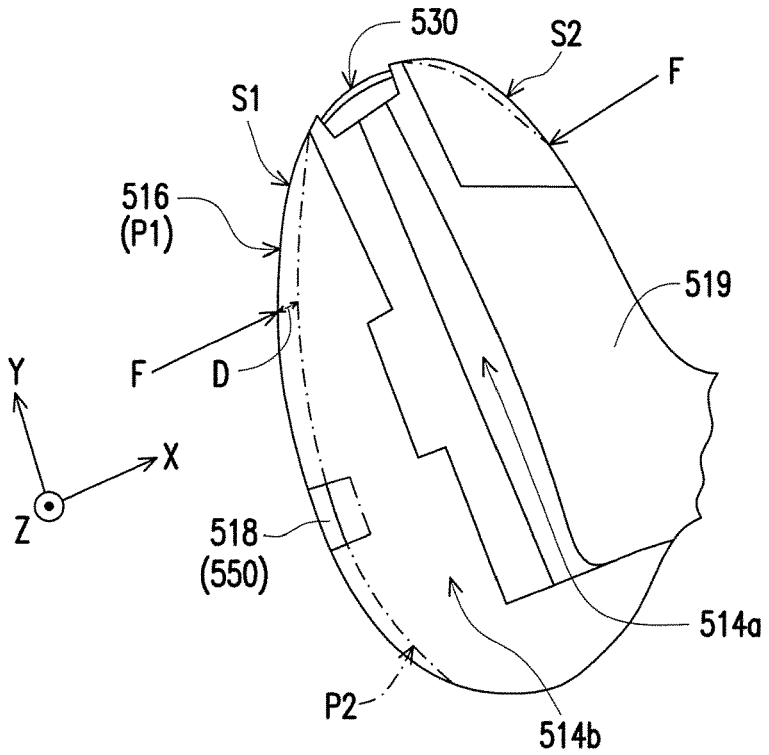
FIG. 5B and FIG. 5C are schematic views illustrating the earphone of FIG. 5A in a state of being subjected to a force.
Figure 5C:
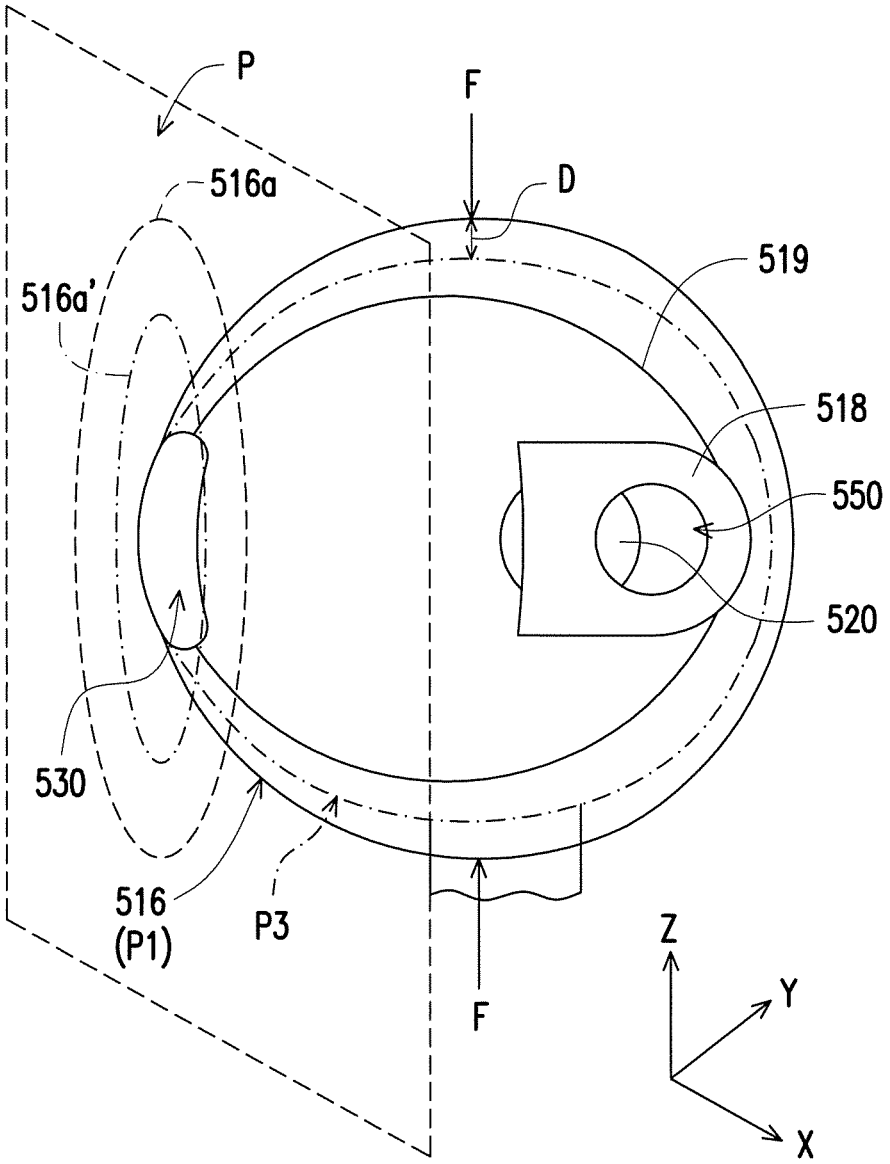

FIG. 5B and FIG. 5C are schematic views illustrating the earphone of FIG. 5A in a state of being subjected to a force. Referring to FIG. 5A to FIG. 5C, a shape of the rear chamber 514*b* of the main body 514 is, for example, changed by an external force F applied onto the deformation region 516 of the deformable housing 510. For instance, referring to FIG. 5A and FIG. 5B, when the deformation region 516 of the deformable housing 510 is squeezed by the external force F in a direction X, the auricle contact surface S1 and the external connecting surface S2 of the main body 514 of the deformable housing 510 become close to each other. After the external force F applied onto the deformation region 516 of the deformable housing 510 is removed from the deformation region 516, the auricle contact surface S1 and the external connecting surface S2 of the main body 514 of the deformable housing 510 become away from each other.

Furthermore, when the external force F is applied onto the deformation region 516 and/or the ventilation sheet 518 along the direction X, the deformation region 516 and the ventilation sheet 518 located at a first position P1 move towards the speaker 520 to a second position P2 and generate a maximum distance D between the first position P1 and the second position P2, thereby changing the shape of the rear chamber 514*b*. In one embodiment, when the external force F is applied onto the deformation region 516 and/or the ventilation sheet 518, the ventilation sheet 518 located at the second position P2 may be abutted against the speaker 520. Moreover, when the external force F applied along the direction X is removed from the deformation region 516 and/or the ventilation sheet 518 of the deformable housing 510, due to the elastic deformation of the deformation region 516, the deformation region 516 and the ventilation sheet 518 located at the second position P2 return back to the first position P1. That is, after the external force F is removed from the deformation region 516, the shape of the rear chamber 514*b* returns back to the initial shape. It can be understood that, the value of the maximum distance D is at least dependent on the stress of the external force F and the material properties of the deformation region 516 and the ventilation sheet 518.

Further, referring to FIG. 5A and FIG. 5C, when the deformation region 516 of the deformable housing 510 is squeezed by the external force F, an orthogonal projection area 516*a*' of the deformation region 516 on a plane P in which the audio outlet 530 is located is smaller than an orthogonal projection area 516*a* of the deformation region 516 on the plane P in which the audio outlet 530 is located after the external force F applied onto the deformation region 516 of the deformable housing 510 is removed from the deformation region 516. Furthermore, when the external force F is applied onto the deformation region 516 along a direction Z, the deformation region 516 located at a first position P1 moves towards the speaker 520 to a third position P3 and generates a maximum distance D between the first position P1 and the third position P3, thereby changing the shape of the rear chamber 514*b*. In addition, when the external force F applied along the direction Z is removed from the deformation region 516 of the deformable housing 510, due to the elastic deformation of the deformation region 516, the deformation region 516 and the ventilation sheet 518 located at the third position P3 return back to the first position P1. That is, when the deformation region 516 is at the first position P1, the orthogonal projection area 516*a* of the deformation region 516 on the plane P in which the audio outlet 530 is located is greater than the orthogonal projection area 516*a*' of the deformation region 516 on the plane P in which the audio outlet 530 is located when the deformation region 516 is located at the third position P3.

It can be understood that, when the external force F is applied onto the deformation region 516 along a direction Y, the deformation region 516 located at a first position P1 moves towards the speaker 520, thereby changing the shape of the rear chamber 514*b*. In addition, FIG. 5B and FIG. 5C merely illustrate exemplary the deformation region 516 being squeezed by the external force F along a single direction; in other embodiments, the deformation region 516 may be influenced by external forces along multiple directions, so that the deformation region 516 moves towards the speaker 520 and produces multi-axial deformations, thereby changing the shape of the rear chamber 514*b*. Moreover, it is to be noted that, since the rigidity of the material of the ventilation sheet 518 is greater than the rigidity of the material of the deformation region 516, the movement positions of the deformation region 516 are limited within the range of the maximum distance D. In addition, when the deformation region 516 produces the elastic deformation as being subjected to the influence of the external force F, the earphone 500 can limit the amount of change in the shape of the rear chamber 514 with the position-limiting from the ventilation sheet 518 and lower a risk of damaging the speaker 520 due to the external force F being too large. That is, regardless of the deformation region 516 being influenced by an external force F of any direction to produce an elastic deformation, the front chamber 514*a* with the protection from the supporting member 519 and the rear chamber 514*b* with the position-limiting from the ventilation sheet 518 result in minimal impacts on low frequency and medium frequency curves of the earphone 500.

In summary, the earphone of the invention, by adjusting a configuration direction of the first speaker and using the baffle or the partition to define the accommodation space so as to further dispose the functional elements in the accommodation space, enables the earphone to have a variety of functions while maintaining its sound quality. In addition, under the configuration in which the sound output surface of the first speaker is facing towards the external connecting surface, a centre of gravity of the overall earphone may be leaned towards the auricle contact surface, namely, leaned towards the user's ear, and thus the earphone does not easily fall off when being worn by the user.

Furthermore, the housing of the earphone of the invention may be the deformable housing including the deformation region with adjusting the configuration direction of the speaker, so that when the user uses the earphone, the deformation region can produce a deformation in conformity to the shape of the auricle of the user. Thus, the earphone of the invention can be comfortably placed within the ear canal without requiring additional earplugs. In this way, the earphone of the invention, in addition to conform with the ear cavities of different users, may also simultaneously increase the air tightness within the ear cavity so as to achieve an effect of improving the sound quality. Moreover, the earphone of the invention, by disposing the ventilation sheet on the auricle contact surface of the main body and with the rigidity of material of the ventilation sheet being greater than the rigidity of the material of the deformation region, in addition to enhancing the structural strength of the deformable housing, may further enable the movement positions of the deformation region as being subjected to a force to be limited by the ventilation sheet, thereby lowering a risk of damaging the speaker or causing malfunction of the speaker, and maintaining the sound quality of the earphone.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An earphone, comprising:

a housing comprising an insertion end and a main body, the insertion end into the entrance of a user's ear when worn by the user, the main body extending from the insertion end and defining an auricle contact surface and an external connecting surface opposite to the auricle contact surface, and the auricle contact surface of the main body being in contact with a conchae of the user, and the external connecting surface facing outwardly with respective to the conchae of the user and communicating to an external environment when the earphone is worn;

a first speaker contained within the main body of the housing to divide the main body into a front chamber and a first rear chamber, wherein a part of the first rear chamber of the main body is adjacent to the auricle contact surface of the main body, and a sound output surface of the first speaker faces the external connecting surface of the housing; and an audio outlet formed in the insertion end of the housing so as to let out the sound.

2. The earphone as recited in claim 1, further comprising:

a first tuning hole formed in the main body of the housing so as to communicate the first rear chamber with the external environment.

3. The earphone as recited in claim 1, further comprising:

a partition, disposed inside the main body of the housing and between the external connecting surface and the first speaker, wherein the partition and the external connecting surface define an accommodation space therebetween.

4. The earphone as recited in claim 3, further comprising:

at least a functional element, located inside the accommodation space.

5. The earphone as recited in claim 1, further comprising:

a front chamber tuning hole, formed in the external connecting surface of the main body of the housing so as to communicate the front chamber with outside of the housing.

6. The earphone as recited in claim 1, further comprising:

a partition, disposed inside the main body of the housing and located between the external connecting surface and the first speaker; and a second speaker, disposed inside the housing and connected between the partition and the main body, wherein the partition and the second speaker share the front chamber with the first speaker, and a second rear chamber is defined by the second speaker and the external connecting surface.

7. The earphone as recited in claim 6, further comprising:

a second tuning hole, formed in the external connecting surface of the main body of the housing so as to communicate the second rear chamber with outside of the housing.

8. The earphone as recited in claim 1, further comprising:

a baffle, located between the auricle contact surface of the main body and the first speaker and communicates to the front chamber.

9. The earphone as recited in claim 1, wherein the main body of the housing is flexible, and when the main body is subjected to an external force, the auricle contact surface and/or the external connecting surface is deformed.

10. An earphone, adapted to be inserted into an ear of a user, the earphone comprising:

a deformable housing comprising an insertion end and a main body, the insertion end into the entrance of a user's ear when worn by the user, the main body extending from the insertion end and defining an auricle contact surface and an external connecting surface opposite to the auricle contact surface, and the auricle contact surface of the main body being in contact with a conchae of the user and the external connecting surface facing outwardly with respective to the conchae of the user and communicating to an external environment when the earphone is worn;

a speaker contained within the main body of the deformable housing to divide the main body into a front chamber and a rear chamber, wherein a part of the rear chamber of the main body is adjacent to the auricle contact surface of the main body, and a sound output surface of the speaker faces the external connecting surface of the deformable housing; and an audio outlet formed in the insertion end of the deformable housing to let out the sound.

11. The earphone as recited in claim 10, wherein the deformable housing comprises a deformation region facing the rear chamber of the main body, and a shape of the rear chamber is changed by an external force applied onto the deformation region.

12. The earphone as recited in claim 11, wherein when the deformation region of the deformable housing is squeezed by the external force, the auricle contact surface and the external connecting surface of the main body of the deformable housing become close to each other.

13. The earphone as recited in claim 11, wherein the deformable housing comprises a ventilation sheet disposed at the auricle contact surface of the main body of the deformable housing, wherein a rigidity of the ventilation sheet is greater than a rigidity of the deformation region.

14. The earphone as recited in claim 13, wherein the auricle contact surface of the main body of the deformable housing is spaced apart from the speaker by the ventilation sheet of the deformable housing.

15. The earphone as recited in claim 13, wherein the ventilation sheet of the deformable housing and the deformation region of the deformable housing are integrally formed.

16. The earphone as recited in claim 10, wherein the deformable housing comprises a supporting member contained within the main body and connected with the speaker, and the supporting member faces the front chamber of the main body.

* * * * *